US006938272B1

(12) United States Patent
Brown

(10) Patent No.: US 6,938,272 B1
(45) Date of Patent: Sep. 6, 2005

(54) PROTECTIVE SPORTS HELMET HAVING A TWO-PIECE FACE CAGE

(75) Inventor: Robin J. Brown, Labadie, MO (US)

(73) Assignee: Rawlings Sporting Goods Company, Inc., Fenton, MO (US)

( * ) Notice: Subject to any disclaimer, the term of this patent is extended or adjusted under 35 U.S.C. 154(b) by 0 days.

(21) Appl. No.: 10/837,307

(22) Filed: Apr. 30, 2004

(51) Int. Cl.[7] ..... A41B 1/00
(52) U.S. Cl. ..... 2/9; 2/424; 2/425
(58) Field of Search ..... 2/9, 424, 425, 2/6.4, 6.5, 6.6, 6.7

(56) References Cited

U.S. PATENT DOCUMENTS

| | | | | |
|---|---|---|---|---|
| 1,196,411 A | | 8/1916 | Welch | |
| 2,020,248 A | * | 11/1935 | Shibe | 2/9 |
| 2,502,377 A | | 3/1950 | Goldsmith et al. | |
| 2,790,175 A | * | 4/1957 | Sowle | 2/9 |
| 3,122,752 A | * | 3/1964 | Marietta | 2/9 |
| 3,608,089 A | * | 9/1971 | Abbatelli | 2/9 |
| 4,042,974 A | * | 8/1977 | Morgan et al. | 2/9 |
| 4,689,835 A | * | 9/1987 | Draft et al. | 2/424 |
| 4,933,993 A | * | 6/1990 | McClelland | 2/424 |
| 4,999,856 A | | 3/1991 | DuVall | |
| 5,129,108 A | | 7/1992 | Copeland et al. | |
| 5,267,353 A | | 12/1993 | Milligan | |
| 5,384,914 A | | 1/1995 | Caveness et al. | |
| 5,603,117 A | * | 2/1997 | Hudner et al. | 2/6.6 |
| 5,661,849 A | * | 9/1997 | Hicks | 2/9 |
| 5,737,770 A | | 4/1998 | Chen | |
| 5,806,088 A | * | 9/1998 | Zide et al. | 2/9 |
| 5,911,308 A | | 6/1999 | Chafitz et al. | |
| 5,953,761 A | * | 9/1999 | Jurga et al. | 2/425 |
| 6,047,400 A | * | 4/2000 | Spencer | 2/9 |
| 6,189,156 B1 | | 2/2001 | Loiars | |
| D448,528 S | | 9/2001 | Fujimoto et al. | |
| 6,292,954 B1 | | 9/2001 | O'Bradaigh et al. | |
| 2001/0054189 A1 | * | 12/2001 | Halstead et al. | 2/9 |

* cited by examiner

*Primary Examiner*—Rodney M. Lindsey
(74) *Attorney, Agent, or Firm*—Stinson Morrison Hecker LLP

(57) ABSTRACT

A protective sports helmet includes a rigid shell configured to fit over a wearer's head, with top, rear, and side portions to protect the top, rear and side of a wearer's head. The shell has a face opening in the area of the wearer's face and an upper face cage attached to the shell so as to cover a part of the face opening to protect the wearer's eyes and upper face. A lower face cage is attached to the shell covering a part of the face opening to protect the wearer's lower face, nose and mouth.

18 Claims, 4 Drawing Sheets

PROTECTIVE SPORTS HELMET HAVING A TWO-PIECE FACE CAGE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to protective helmets, and more particularly to protective sports helmets having face protectors.

2. Description of Related Art

Protective helmets are commonly used by players in various sports, and in fact are often required in league play and professional sports such as baseball and hockey. In baseball for example, batters and catchers are required to wear protective headgear to protect their heads, with the catcher's headgear additionally required to have a face protector.

Typical catcher's masks include a padded frame that surrounds the catcher's face, with a single-piece face cage attached to the front of the frame to cover and protect the catcher's face. The padded frame is attached to a helmet or straps which secures the frame to the catcher's head. Since the catcher is regularly exposed to baseballs traveling at speeds approaching one-hundred miles per hour, the face cages used in catcher's masks must be constructed of high-strength material. In order to provide adequate protection, conventional face cages for catcher's masks are single piece cages constructed of metal, configured to cover and protect the catcher's entire face.

While these single piece metal cages provide protection to the catcher, they are also heavy and cumbersome, and prolonged wearing of a catcher's mask having a metal face cage can tire the catcher's head and neck. In addition, if the metal face cage is struck by a stray baseball, the metal tends to become permanently bent or dented. Repeated strikes can cause metal fatigue and eventually break the metal cage.

Thus, there remains a need in the art for a protective face cage that is lightweight, provides adequate protection to the wearer, and does not easily wear or fatigue.

BRIEF SUMMARY OF THE INVENTION

The present invention is directed to a protective sports helmet having a strong, lightweight, two-piece face cage, wherein the two pieces of the face cage are made of dissimilar materials. The two-piece face cage includes an upper cage made from tubular metal and a lower cage made from a strong, lightweight polymeric material. The lightweight face cage reduces catcher fatigue during periods of prolonged wear, and the polymeric lower face cage provides protection against stray baseballs without suffering from permanent denting or fatigue as in conventional one-piece metal face cages.

In one exemplary embodiment, the helmet includes a rigid shell configured to fit over a wearer's head, with top, rear, and side portions to protect the top, rear and sides of a wearer's head. The shell has a face opening in the area of the wearer's face with an upper face cage made of tubular metal attached to the shell so as to cover a portion of the face opening to protect the wearer's eyes and upper face. A lower face cage made of a polymeric material is attached to the shell covering a portion of the face opening to protect the wearer's lower face, nose and mouth. Openings in the lower face cage provide ventilation and further reduce the weight of the face cage.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF EXEMPLARY EMBODIMENTS

A protective sports helmet according to a first exemplary embodiment of the present invention is depicted in FIGS. 1 through 4. While the invention will be described in detail hereinbelow with reference to this embodiment, it should be understood that the invention is not limited to the specific constructions or configurations shown in the exemplary embodiment. Rather, one skilled in the art will appreciate that a variety of configurations may be implemented in accordance with the present invention.

Figure 1:
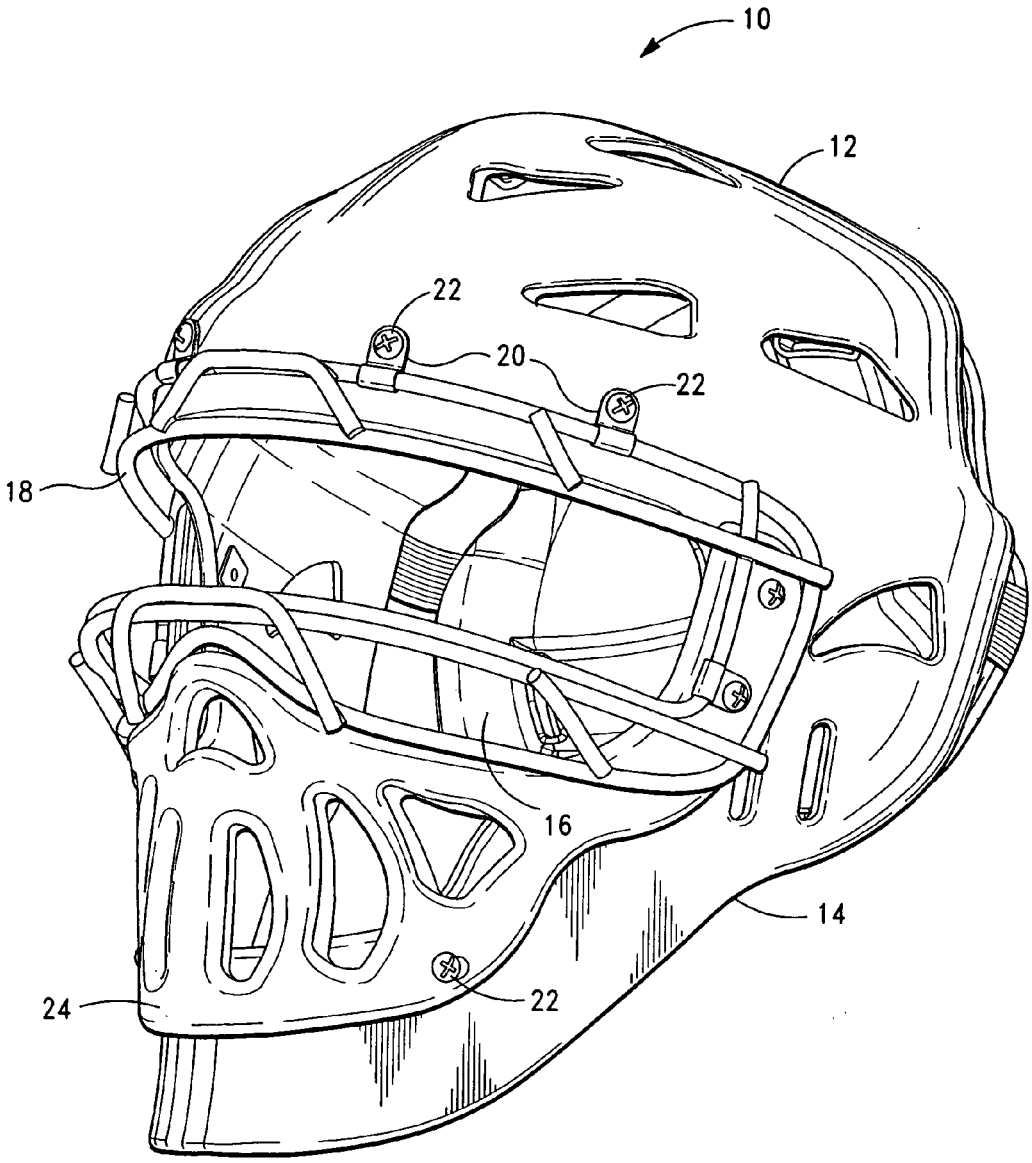
FIG. 1 is a perspective view of an exemplary embodiment of a protective helmet in accordance with the present invention.
Figure 2:
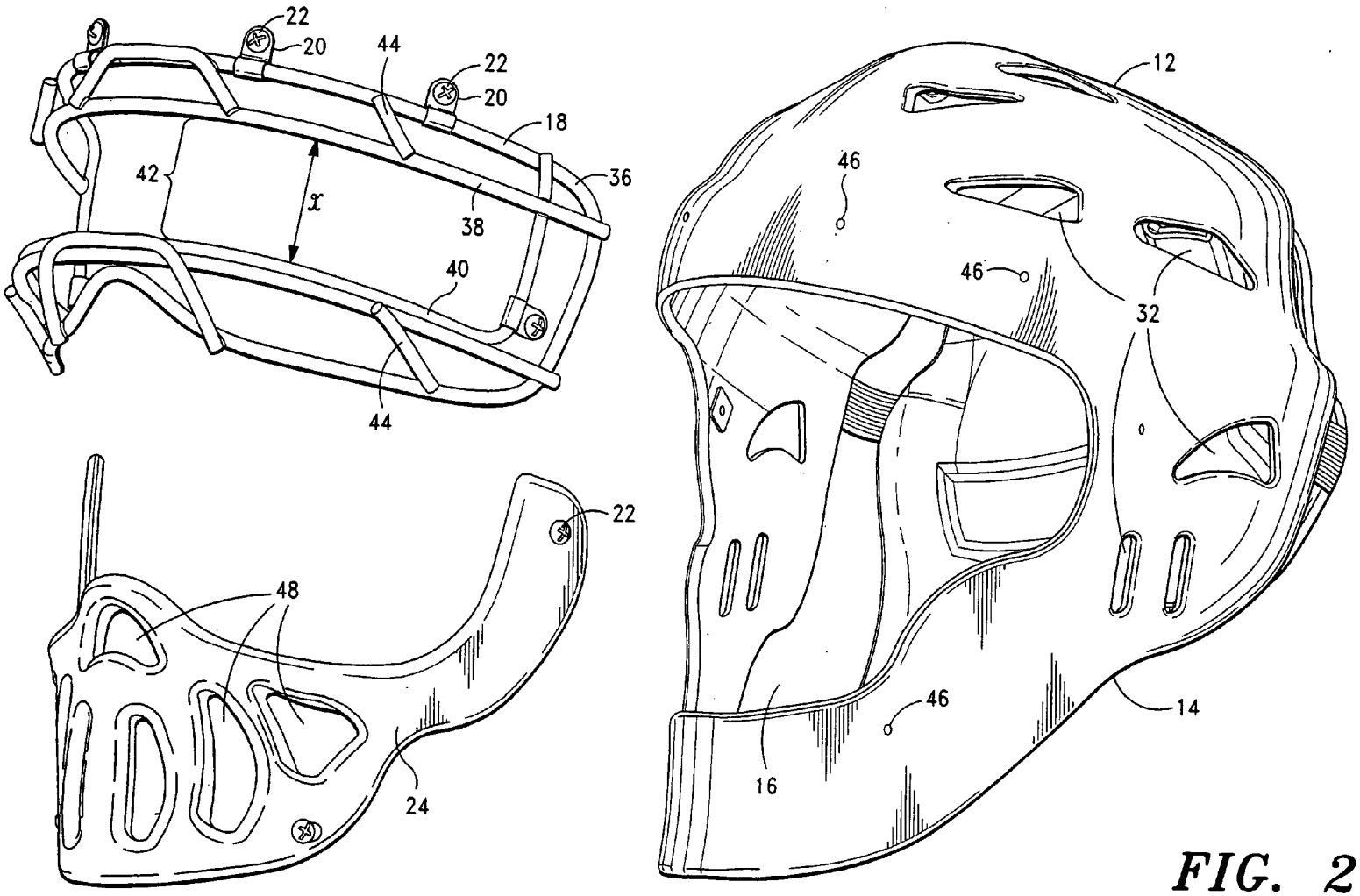
FIG. 2 is an exploded view of the protective helmet of FIG. 1.

Looking first to FIGS. 1 and 2, a protective sports helmet having a two-piece face cage in accordance with an exemplary embodiment of the present invention is depicted generally by the designation 10. Helmet 10 includes a rigid shell 12 defining a cavity 14 configured to fit over a wearer's head, and further defining a face opening 16 in the area of the wearer's face. An upper face cage 18 attaches to rigid shell 12 with clips 20 and fasteners 22 to cover a portion of face opening 16 to protect the wearer's eyes, and a lower face cage 24 attaches to rigid shell 12 with fasteners 22 to cover the remaining portion of face opening 16 to protect the wearer's nose, mouth, and lower face. With both upper face cage 18 and lower face cage 24 fastened to rigid shell 12, face opening 16 is substantially covered by the face cages.

Figure 3:
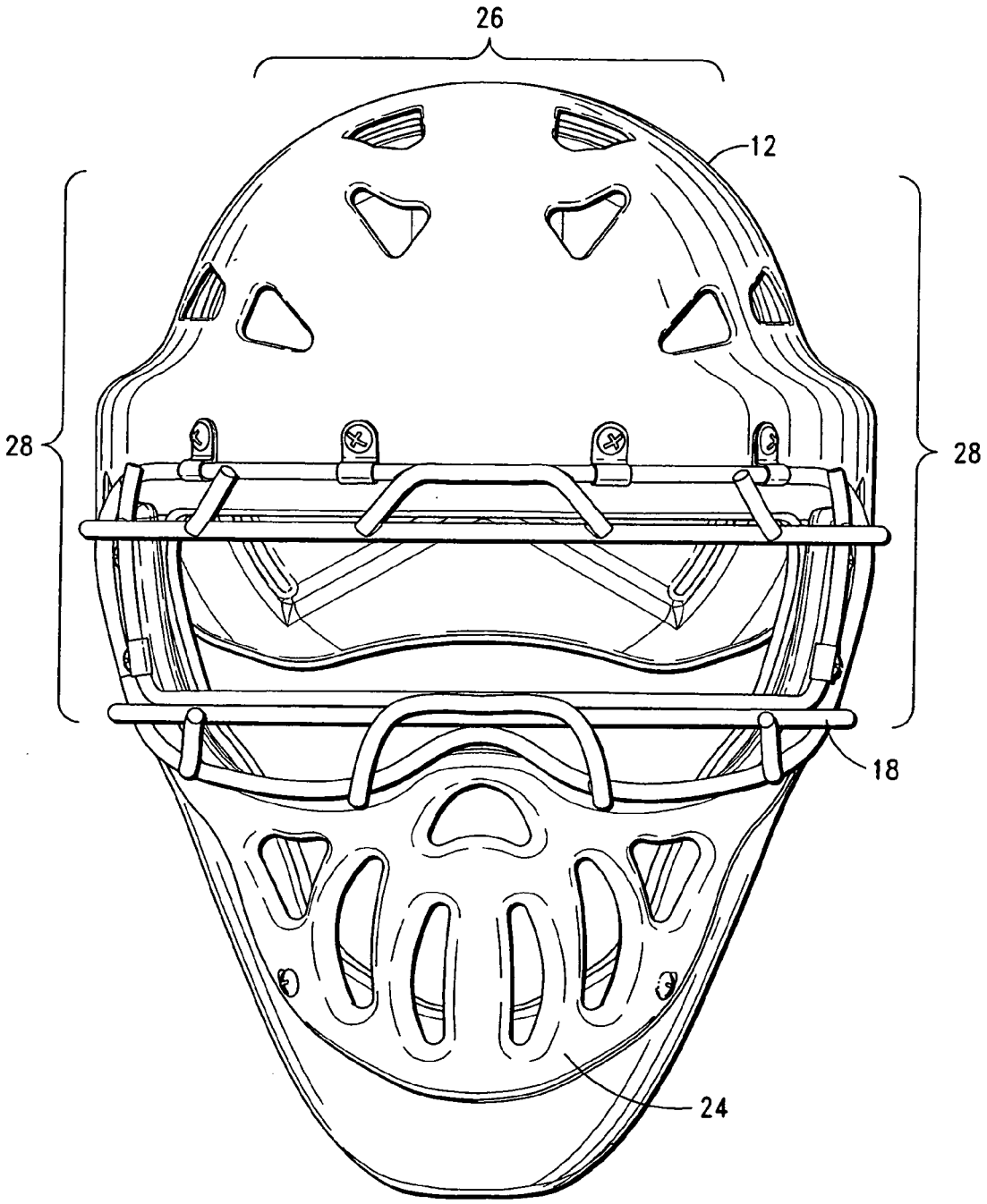
FIG. 3 is a front view of the protective helmet of FIG. 1.
Figure 4:
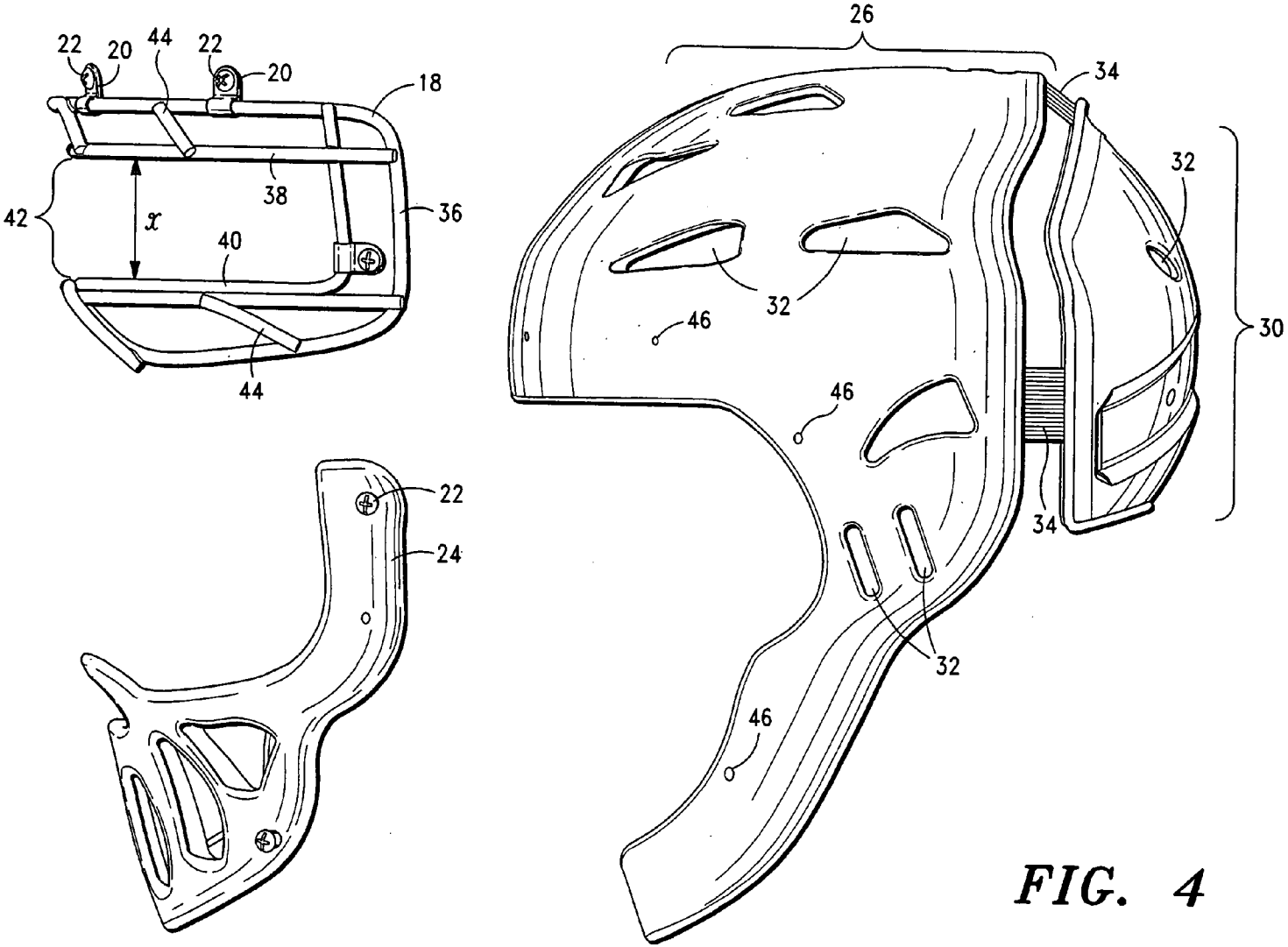
FIG. 4 is an exploded, side view of the protective helmet of FIG. 1.

As best seen in FIGS. 3 and 4, rigid shell 12 has a top portion 26, side portions 28, and a rear portion 30 to protect the top, sides, and rear portions of the wearer's head, respectively. Ventilation openings 32 formed through rigid shell 12 along each of the top, side, and rear portions 26, 28, 30 allow air flow to cool the wearer's head and also reduce the overall weight of the protective helmet. Side portions 28 extend all the way down the side of the wearer's head, and wrap to meet around the center front of the helmet to cover the wearer's chin. Other configurations of side portions 28 will be apparent to those skilled in the art, and are within the scope of the present invention, such as side portions that extend downwardly along the sides of the wearer's head only and do not meet or otherwise extend to cover the chin.

As seen in FIG. 4, rear portion 30 of rigid shell 12 is a separate piece, and is attached to top and side portions 26, 28 with elastic straps 34. Straps 34 allow rear portion 30 to be pulled slightly away from the top and side portions to allow easily fitting the rigid shell over the wearer's head. Once in place, straps 34 pull rear portion 30 snugly against the back of the wearer's head to keep the protective helmet securely in place. Straps 34 may be attached by gluing or fastening to top, front, and rear portions 26, 28, 30, they may be sandwiched between the rigid shell and an interior pad on any of the portions, or they may be attached using any combination of these methods. While straps 34 are preferably elastic straps approximately 1½ inches wide, other configurations or types of self-retractable material may used.

Rigid shell 12 may be constructed of any sturdy material capable of withstanding a strike from a baseball or bat. Preferably, rigid shell 12 is constructed of a rigid plastic material such as Acrylonitrile Butadiene Styrene (ABS) or Polycarbonate. Rigid shell 12 may be custom manufactured to accommodate head sizes from extra small (6-⅜) to extra large (7-½), or may be manufactured to an intermediate one-size-fits-all configuration with various sizes of removable pads attached to the interior cavity 14 side of rigid shell 12 to size the protective helmet to a particular wearer. Any configuration of rigid shell 12 may include soft pads or padding at locations along the interior cavity 14 side to provide a snug, comfortable fit to the wearer's head as is known in the art.

Looking to FIG. 2, upper face cage 18 is comprised of tubular metal, with a mounting frame 36 configured to conform in shape to rigid shell 12 in the area around the upper portion of face opening 16. Mounting frame 36 includes a top bar extending horizontally across the upper portion of the mounting frame and a bottom bar extending horizontally across the lower portion of the mounting frame, with side bars connecting the upper bar and lower bar to form mounting frame 36. The lower bar includes a protruding nose bridge portion to provide clearance from the wearer's nose. An upper frame 38 and a lower frame 40 extend horizontally across mounting frame 36 to form an unobstructed viewing space 42 in the area of the wearer's eyes. Upper frame 38 and lower frame 40 are attached to mounting frame 36 via struts 44 which also act to space upper frame 38 and lower frame 40 outwardly from mounting frame 36.

Struts 44 may be welded or glued to the frames, or other fastening methods known in the art may be employed. Alternatively, the upper cage may be formed as a unitary piece such as by casting or molding. Other materials or fastening methods for upper cage 18 will be apparent to those skilled in the art, and are within the scope of the present invention.

Preferably, upper face cage 18 is made from a rigid tubular metal such as steel, aluminum, or titanium, having a diameter of approximately 3/16 inches. Most preferably, upper face cage 18 is made from solid tubular steel having a diameter of 4.8 millimeters. While solid tubular metal is preferred for face cage 18, hollow tubular metal may also be used. Upper face cage 18 is configured so as to comply with the performance requirements set forth in section 5.3 of the National Operation Committee on Standards for Athletic Equipment (NOCSAE) document (ND)024-03m03, revised April 2003. Upper frame 38 and lower frame 40 are spaced apart by distance x to provide unobstructed viewing space 42 along the entire length of upper and lower frames 38, 40. Unobstructed viewing space 42 allows wearers to have an unobstructed view from the protective helmet along their entire horizontal viewing field, even in the peripheral vision areas at the sides of their head. The distance x spacing between upper frame 38 and lower frame 40 is preferably less than the diameter of a regulation baseball, approximately 2.5 inches. Most preferably, distance x is approximately 1.5 inches to provide protection from baseballs and to provide a large unobstructed viewing space 42.

Looking still to FIG. 2, generally jaw-shaped lower face cage 24 is comprised of a rigid plastic material, and formed to conform in shape to rigid shell 12 in the area around the lower portion of face opening 16. An upper portion of lower face cage 24 is formed to fit over the lower portion of the wearer's nose, having a protruding area to provide clearance for the nose. Breathing and ventilation openings in the lower portion of lower face cage 24 allow air to the wearer's nose and mouth areas, and reduce the weight of lower face cage 24. Thus, lower face cage 24 provides strong, lightweight protection to the wearer.

Lower face cage 24 is made from a rigid polymeric material, preferably a moldable plastic. More preferably, lower face cage 24 is made of a thermoplastic having sufficient tensile strength and impact resistance to adequately protect the wearer, such as nylon. A suitable material for this purpose is nylon 66, such as DuPont's Zytel® brand nylon resin. Preferably the material utilized for lower face cage 24 will have sufficient tensile strength, impact resistance, and other properties to achieve a face cage that complies with the performance requirements set forth in section 5.3 of the National Operation Committee on Standards for Athletic Equipment (NOCSAE) document (ND) 024-03m03, revised April, 2003, such as nylon.

As seen in FIG. 2, fasteners 22 at various locations around lower face cage 24 attach lower face cage 24 to rigid shell 12. Attachment holes 46 in rigid shell 12 receive fasteners 22 to securely attach lower face cage 24 to the rigid shell 12. Other fastening methods known in the art such as riveting or gluing may also be used to attach the lower face cage to the rigid shell.

The metal upper face cage provides a strong protective cage, while also providing an unobstructed viewing area for the wearer. The nylon lower face cage provides strong, lightweight protection to the wearer, while still allowing ventilation and breathability. Thus, the protective sports helmet having a two-piece face cage of the present invention provides improved comfort and viewability to the wearer, while reducing fatigue from prolonged wearing, all without sacrificing any safety.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

The terms "substantially", "approximately", and "relatively" as used herein may be applied to modify any quantitative representation which could permissibly vary without resulting in a change in the basic function to which it is related. For example, the spacing between upper frame 38 and lower frame 40 disclosed herein as being approximately 1.5 inches may permissibly vary from this dimension and still be within the scope of the invention if the variance does not materially alter the capability of the invention. Likewise, the variance from any quantitative representation, such as proximate or adjacent as used herein, is permissible if the variance does not materially alter the capability of the invention.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A protective sports helmet comprising:

a rigid shell defining a cavity configured to fit over a wearer's head and having a top, rear, and side portions shaped to protect the top, rear, and side areas of a wearer's head, said shell configured to define a face opening in the area of said wearer's face;

an upper face cage attached to said rigid shell such that said upper cage covers a portion of said face opening to protect said wearer's upper face and eyes; and a lower face cage attached to said rigid shell such that said lower cage covers a portion of said face opening to protect said wearer's lower face and mouth, wherein said upper face cage and said lower face cage are made of dissimilar materials.

2. The protective helmet of claim 1, wherein said upper cage comprises tubular metal.

3. The protective helmet of claim 2, wherein said tubular metal is selected from the group consisting of steel, titanium, and aluminum.

4. The protective helmet of claim 2, wherein said upper cage comprises an upper frame and a lower frame, wherein said frames define an opening through which said wearer's view is substantially unobstructed.

5. The protective helmet of claim 4, wherein a distance between said upper frame and said lower frame is less than 2.5 inches.

6. The protective helmet of claim 5, wherein a distance between said upper frame and said lower frame is approximately 1.5 inches.

7. The protective helmet of claim 1, wherein said lower cage comprises a polymeric material.

8. The protective helmet of claim 7, wherein said polymeric material comprises a plastic material.

9. The protective helmet of claim 8, wherein said plastic material comprises nylon.

10. The protective helmet of claim 9, wherein said nylon is nylon 66.

11. The protective helmet of claim 7, wherein said lower cage comprises a plurality of openings in the area of said wearer's mouth and nose.

12. The protective helmet of claim 1 wherein said rear portion is attached to said side and top portions with expandable connectors to allow fitting said helmet snugly to said wearer's head.

13. A protective sports helmet comprising:

a rigid shell defining a cavity configured to fit over a wearer's head and defining a face opening in the area of said wearer's face;

a tubular metal upper face cage attached to said rigid shell to extend across an upper portion of said face opening to protect said wearer's upper face and eyes, said upper face cage defining an opening through which said wearer's view is substantially unobstructed; and a polymeric material lower face cage made attached to said rigid shell to extend across a portion of said face opening to protect said wearer's lower face and mouth, said lower face cage comprising a plurality of openings in the area of said wearer's mouth and nose.

14. The protective helmet of claim 13, wherein said tubular metal is selected from the group consisting of steel, titanium, and aluminum, and wherein said polymeric material is nylon.

15. The protective helmet of claim 14, wherein said nylon is nylon 66.

16. A face cage for use with a protective helmet, said face cage comprising:

an upper face cage made of tubular metal configured to extend across a face opening in said helmet, said upper face cage defining an opening through which a wearer's view is substantially unobstructed; and a lower face cage made of a polymeric material configured to extend across a face opening in said helmet, said lower face cage comprising a plurality of openings in the area of said wearer's mouth and nose.

17. The face cage of claim 16, wherein said tubular metal is selected from the group consisting of steel, titanium, and aluminum, and wherein said polymeric material is nylon.

18. The face cage of claim 17, wherein said nylon is nylon 66.

* * * * *